United States Patent [19]

McVey et al.

[11] 4,227,169

[45] Oct. 7, 1980

[54] COMBINED THERMAL AND ELECTRICAL CUT-OFF DEVICE

[75] Inventors: John K. McVey, Bensenville; Larry L. Sharp, Schaumburg, both of Ill.

[73] Assignee: Illinois Tool Works Inc., Chicago, Ill.

[21] Appl. No.: 37,988

[22] Filed: May 10, 1979

[51] Int. Cl.[3] ..... H01H 85/02; H01H 85/20

[52] U.S. Cl. ..... 337/182; 337/12; 337/185; 337/403

[58] Field of Search ..... 337/182, 183, 184, 185, 337/1, 4, 5, 6, 12, 401–409

[56] References Cited

U.S. PATENT DOCUMENTS

| | | | |
|---|---|---|---|
| 3,839,692 | 10/1974 | Plasko | 337/182 |
| 4,164,220 | 8/1979 | Brickell et al. | 73/362 R |

FOREIGN PATENT DOCUMENTS

| | | | |
|---|---|---|---|
| 1023995 | 3/1953 | France | 337/182 |
| 365307 | 1/1932 | United Kingdom | 337/182 |

*Primary Examiner*—Harold Broome

*Attorney, Agent, or Firm*—Glenn W. Bowen; Robert W. Beart

[57] ABSTRACT

The device described herein is useful in applications which formerly required both a thermal cut-off device and an electrical fuse. This device will open an electrical circuit in response to either an increase in ambient temperature or an increase in electrical current. A bracket is provided to support a radial lead thermal cut-off device. The bracket is of a general C-shaped configuration and has an extending lead bar that is crimped into electrical engagement with an input lead, and one radial lead of the thermal cut-off device is crimped into electrical engagement with the second input lead. A helical conductive coil has one end welded or otherwise secured to the C-shaped bracket, and the second lead of the thermal cut-off device is crimped to the other end of the helical coil which is positioned over the thermal cut-off device so as to surround it. Thus, an ambient temperature rise may cause the thermal cut-off device to open the electrical circuit; or alternately the heat generated by the $I^2R$ loss in the coil due to excessive electrical current flow may cause the device to also open.

2 Claims, 4 Drawing Figures

Fig. 1
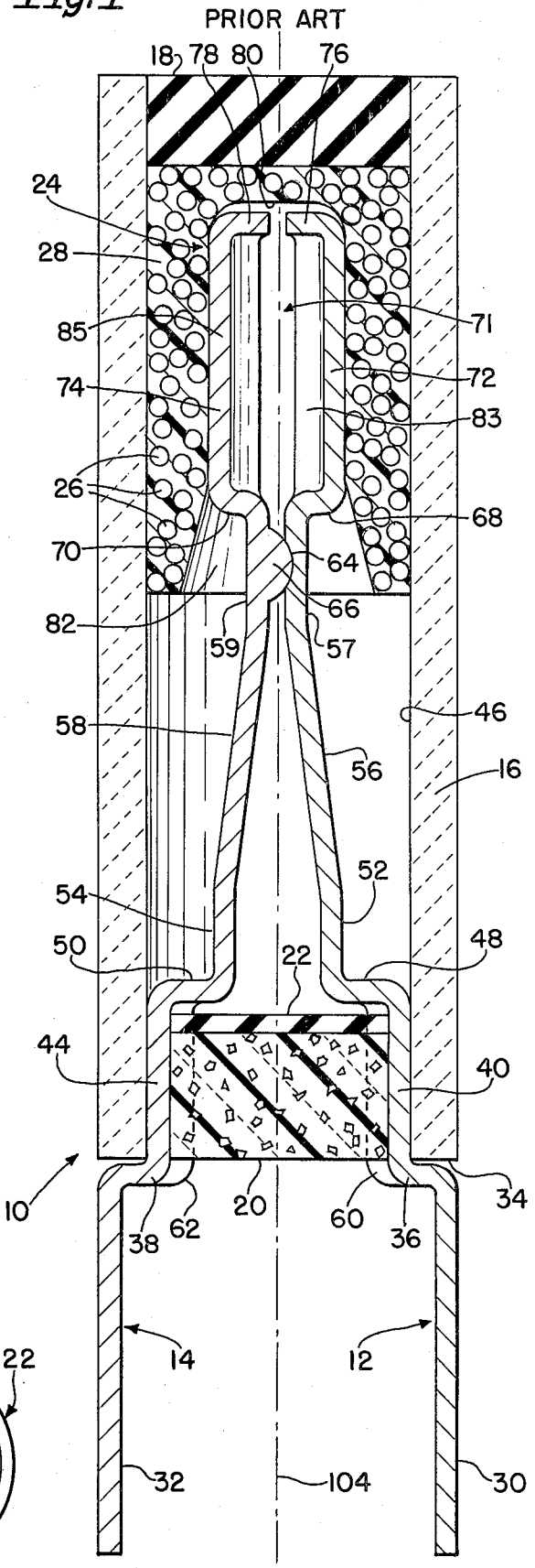
Fig. 2
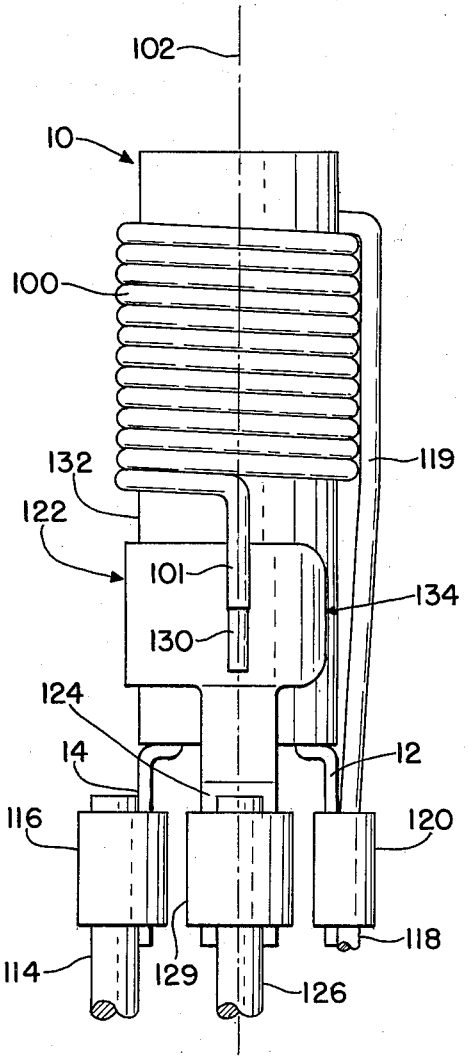
Fig. 3
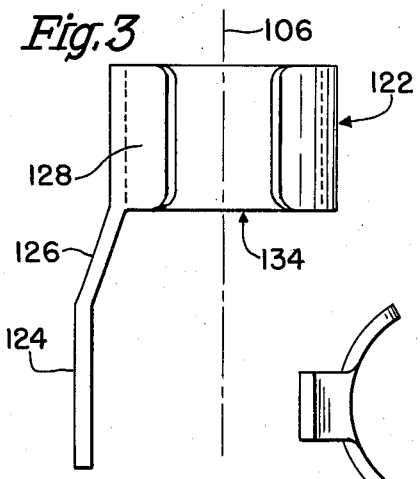
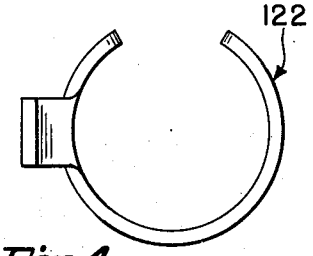
Fig. 4

COMBINED THERMAL AND ELECTRICAL CUT-OFF DEVICE

BACKGROUND OF THE INVENTION

At the present time there are a number of applications which require both a thermal cut-off device for opening an electrical circuit when the ambient temperature rises above a predetermined amount, and also an electrical fuse for opening the circuit when the electrical current rises above a critical level. In the present invention a single device is provided which gives both thermal and electrical cut-off protection in a cost effective manner.

DESCRIPTION OF THE DRAWINGS

The present invention is described by reference to the drawings in which:

FIG. 1 is a cross-sectional view of a radial leaded thermal cut-off device which may be utilized in conjunction with the present invention;

FIG. 2 is a side view of the combined thermal and electrical cut-off device of the present invention;

FIG. 3 is a side view of the support bracket for the electrical coil of FIG. 1; and FIG. 4 is a top view of the support bracket of FIG. 3.

TECHNICAL DESCRIPTION OF THE INVENTION

The present invention is a combined thermal cut-off fuse and electrical cut-off device which opens an electrical circuit whenever the ambient temperature rises above a predetermined amount or the the electrical current in the circuit rises above a critical level. The active component of the device is a radial lead thermal cut-off device which may be any commercially available cylindrical shaped device of this kind; however, a particularly suitable device is the thermal cut-off fuse that is described in the co-pending U.S. Pat. application Ser. No. 940,418 filed Sept. 7, 1978 in the name of John K. McVey et al and assigned to the assignee of the present invention. The construction of this thermal cut-off device is described by reference to FIG. 1 in which the thermal cut-off device 10 of the aforementioned McVey et al application has a pair of radial leads 12, 14 which extend out of the cylindrical insulated housing 16, which is made of ceramic or other electrically insulating material. The top of the housing 16 is sealed by an insulating plug 18 of a suitable type, for example, silicone, epoxy or other conventional sealing materials. The lower portion of the housing is sealed by an insulating cement layer 20, which preferably is of a chemical-setting, ceramic-type, such as Sauerisen Cement No. 63, which is produced by Sauerisen Cements Company. Here again, other types of conventional sealing materials may alternately be used. The cement layer 20 is supported on an insulating washer 22 which is preferably made of a silicone-bonded mica, which is held by the leads 12, 14, as will subsequently be described in more detail.

The cylindrical temperature sensing pellet 24 of the present invention is formed of a unified mixture of an organic material and a multitude of spherical glass beads 28, wherein the organic material surrounds the multitude of glass beads and holds them together in a unified mass. The mixture of glass beads and organic material has a high volume of glass beads relative to the volume occupied by the organic material, and this provides a thermal-sensing pellet that has a greatly increased strength over that of conventional pressed pellets.

The leads 12, 14 are constructed with generally parallel terminal ends 30, 32 that extend below the housing 16. Just beyond the bottom edge 34 of the housing, the inward bends 36, 38 of the leads 12, 14 reduce the spacing between the leads so as to provide a stop for the leads 12, 14 at this point. Short, straight parallel sections 40, 44 of the leads 12, 14 then run in intimate contact with the inside wall 46 of the housing 16, thereby helping to support the leads, to the inward bend sections 48, 50. The inward bend sections 48, 50 project inwardly in a direction that is substantially normal to the lead sections 40, 44 and act to support the insulating washer 22. The leads 12, 14 are then bent upwardly so as to form a pair of short parallel straight segments 52, 54, which are joined by a pair of tapered segments 56, 58 that slope inwardly towards each other. The leads 12, 14 also have transversely extending ridges 60, 62 which extend from the sections 40, 44 up to approximately the center of these sections to provide added rigidity to the leads and additional surface area where the cement layer 20 may grip the leads in order to provide a stronger seal. The leads 12, 14 from the bends 48, 50 to the bends 36, 38 may be roughened, or cross-hatched, to strengthen the adhesion of the cement layer 20 to the leads 12, 14, if desired. The portions of the leads 12, 14 that extend below the bends 36, 38 may also be roughened, or cross-hatched, if desired, in order to provide for good surface adhesion of the plating material that is applied to the leads.

The contact portions of the leads 12, 14 are shown immediately above the tapered sections 56, 58. The lead 12 has a socket 64 formed in it which receives a mating ball 66 formed on the lead 14 to provide a normally closed switch. The ball 66 and the socket 64 combination allows for increased current capacity, with a lower temperature rise occurring in the leads for any given current and also for easier assembly of the leads 12, 14 into the housing 16 since the leads will tend to lock together when the ball is fitted into the socket. Above the ball and socket connection, the leads 12, 14 are provided with reverse bend sections 68, 70 and a pair of straight, parallel sections 72, 74 which are spaced apart farther due to the reverse bend sections 68, 70 so that a larger bore 71 may be provided in the pellet 24. The leads then terminate in the inwardly bent sections 76, 78 which are provided to keep the ends of the leads from scraping the inside of the pellet 24 when they are inserted into the bore 71. Strengthening ridges 82, 84 are preferably provided down the center of the parallel sections 72, 74 to add rigidity to the leads in this area.

The thermal switch of the present invention, as previously mentioned, utilizes a pellet 24 which is the unified mixture of organic material that melts at a predetermined temperature and a multitude of spherical glass beads that remain solid at this temperature. The pellet extends from the top plug 18 to a line just below the contact structure that is formed by the socket 64 and the ball 66. The bore 82 in the pellet 24, which initially receives the leads 12, 14, preferably is larger in diameter at the top of the bore 82 than the bore 71 in order to facilitate insertion of the leads 12, 14 into the pellet 24. The pellet strength required to hold the leads 12, 14 in contact with each other, as shown in FIG. 1, is in a large measure provided by the beads 26, which may be spherical, or of other shapes, and which may be made of glass or other solid insulating material. When the organic material 28 melts, it no longer is able to hold the spherical beads 26 in place, and therefore they will move and as a result the movement of the spring load leads, 12, 14 will separate, thereby breaking the electrical contact between the leads 12, 14 that was established by the ball and socket connection. With the insulating beads 26 included in the pellet, the organic material no longer need be relied on to provide all of the strength of the pellet. A more reliable and less fragile sensing pellet is thereby provided. Additionally, the possibility of using organic sensing materials that previously might have been rejected because of low structural strength now is a possible alternative.

The leads 12, 14 preferably have a bimetallic structure of copper and stainless steel layers. These layers are preferably plated with a flash of nickel and silver. The copper layer provides a large current carrying capacity for the leads while the stainless steel layer provides for good spring action at elevated temperatures. The stainless steel layer is preferably provided so that it faces the cylindrical inside wall 46 while the copper layers of the two leads face each other. The silver plating over the leads will reduce contact resistance while the nickel flash plating is employed to prevent migration of the silver into the copper layer at elevated temperatures.

The term "insulating" as used herein in describing the properties of various components of the described thermal switch refers to the property of electrical insulation. Thus, while glass beads are good electrical insulators, they are also relatively good conductors of heat, and this is an advantage in the manufacture of the device as described subsequently herein.

A thermal cut-off device such as the device 10 of FIG. 1 is useful as a device which will protect the circuit both from ambient temperature and excessive electrical current when it is combined with the electrical coil 100 which is helically shaped and has a central axis 102 that is in alignment with the longitudinal axis 104 of the thermal cut-off device 10. One radial lead 14 of the thermal cut-off device is crimped to one input wire 114 of the protected circuit by means of the electrical crimped connector 116. The other lead 12 of the device is crimped to one terminal end of the helical coil 118 by means of a crimped connector 120.

The C-shaped support bracket 122 that is shown in FIGS. 2–4 supports both the thermal cut-off device 10 and the coil 100. A downwardly extending lead bar 124 having an angled intermediate portion 126 joins the C-shaped band 128 that supports the thermal cut-off device. The lead bar 124 is crimped to the other input wire 126 of the protected circuit by the crimped connector 129. The electrically conductive C-shaped bracket 122 is soldered or welded or secured by other means to the terminal end 130 of the coil 100. The coil 100 preferably has an insulation coating 101 on it. It is noted that the C-shape of the support bracket 122 allows the length of wire 119 leading to the terminal end 118 of the coil 100 to pass adjacent the outer surface 132 of the thermal cut-off device near the open end 134 of the support bracket in close proximity. This feature allows for the possibility of using uninsulated wire, if desired, when assembled as shown in FIG. 2. The central axis 106 of the C-shaped bracket is in alignment with the axis 102 of the coil 100.

A series electrical circuit between the input wires 114 and 126 is therefore obtained from the wire 126 through the lead bar 124 and the C-shaped bracket 122 to the lead 130 of the coil 100. The electrical current then flows through the coil 100 to the terminal end 118 of the coil 108, which is connected to the lead 12 of the thermal cut-off device. The current then continues its series path through the cut-off device to the opposite lead 14 of the thermal cut-off device to the other input wire 114. The electrical circuit is therefore maintained through the electrical coil and the contacts of the thermal cut-off device in series. Thus, if the ambient temperature rises above a predetermined amount, the thermal cut-off device will operate to open the circuit between the wires 114 and 126. On the other hand, if the ambient temperature is below the cut-off temperature of the device, but the electrical current exceeds a predetermined critical level, there will be a heating loss produced by the current through the coil 100 which is in excess of the value needed to open the thermal cut-off device. Protection is thereby provided for both excessive ambient temperature and excessive electrical current in a cost effective manner.

What is claimed is:

1. A combined thermal and electrical cut-off device comprising a radial lead thermal cut-off device having radial leads which opens a series circuit connection between said radial leads when the ambient temperature is exceeded wherein said radial lead thermal cut-off device has an elongated cylindrical body with a longitudinal axis, an open helical electrically conductive coil that has a central axis for receiving said elongated thermal cut-off device therein so that the central axis of the coil and the longitudinal axis of the thermal cut-off device are approximately in alignment, a first terminal end of said electrical coil being electrically connected to one of the radial leads of said thermal cut-off device and the other radial lead of said thermal cut-off device being electrically connected to a first input wire of the protected circuit, and a general C-shaped electrically conductive support bracket for supporting both said thermal cut-off device and said coil which has a central axis which is approximately in alignment with the axis of said helical coil, said support bracket having a ring portion and an integral lead bar that extends from said ring portion with said ring portion being located intermediate said electrical coil and said input wires, with the second terminal end of said helical coil being electrically connected to said bracket, said lead bar being electrically connected to a second input wire of the protected circuit.

2. A device as claimed in claim 1 wherein said ring portion of said bracket is open at one end and this open end faces said first terminal end of said coil.

* * * * *